US005467066A

United States Patent [19]

Schulze-Buxloh

[11] Patent Number: 5,467,066

[45] Date of Patent: Nov. 14, 1995

[54] RADIATING HIGH-FREQUENCY COAXIAL CABLE

[75] Inventor: Karl Schulze-Buxloh, Monchengladbach, Germany

[73] Assignee: Kabel Rheydt Aktiengesellschaft, Moenchengladback, Germany

[21] Appl. No.: 305,149

[22] Filed: Sep. 13, 1994

[30] Foreign Application Priority Data

Sep. 14, 1993 [DE] Germany ..... 43 31 171.7

[51] Int. Cl.[6] ..... H01Q 13/20

[52] U.S. Cl. ..... 333/237; 343/770

[58] Field of Search ..... 333/237; 343/770, 343/771

[56] References Cited

U.S. PATENT DOCUMENTS

| | | | |
|---|---|---|---|
| 2,756,421 | 7/1956 | Harvey et al. | 343/770 |
| 3,106,713 | 10/1963 | Murata et al. | 343/770 |
| 3,781,725 | 12/1973 | Yoshida et al. | 333/237 |
| 4,152,648 | 5/1979 | Delogne | 333/237 X |
| 4,322,699 | 3/1982 | Hildebrand et al. | 333/237 |
| 4,325,039 | 4/1992 | Allebone | 333/237 |
| 5,276,413 | 1/1994 | Schulze-Boxloh | 333/237 |

FOREIGN PATENT DOCUMENTS

| | | |
|---|---|---|
| 0375840 | 4/1990 | European Pat. Off. . |
| 0502337 | 9/1992 | European Pat. Off. . |

OTHER PUBLICATIONS

1992 IEEE International Conference on Selected Topics in Wireless Communications, Jun., 1992, titled "Variable Leaky Feeders for Cellular Radio Systems" by Karl Schulze–Buxloh, pp. 111–114.

*Primary Examiner*—Paul Gensler

*Attorney, Agent, or Firm*—Ware, Fressola, Van Der Sluys & Adolphson

[57] ABSTRACT

In a radiating high-frequency coaxial cable with openings in the outside conductor (6), which are essentially slots (7) cut perpendicular to the cable axis, sections with periodically repeating slot configurations are provided along the cable, which differ in period length with a constant number of slots per period length, and/or differ in the number of slots per period length while the period length remains constant.

22 Claims, 3 Drawing Sheets

| 23 cm | 20 cm | 17 cm | 17 cm | 17 cm | 17 cm | 17 cm | 16.5 cm |
|---|---|---|---|---|---|---|---|
| 1 | 1 | 1 | 2 | 4 | 8 | 16 | 16 |

FIG. 5

| 20 cm | 19 cm | 18 cm | 17 cm | 17 cm | 17 cm | 17 cm | 17 cm | 16 cm |
|---|---|---|---|---|---|---|---|---|
| 1 | 1 | 1 | 1 | 2 | 4 | 8 | 16 | 16 |

FIG. 6

| 19 cm | 18 cm | 17 cm | 18 cm | 17 cm |
|---|---|---|---|---|
| 1 | 1 | 8 | 4 | 8 |

FIG. 7

RADIATING HIGH-FREQUENCY COAXIAL CABLE

BACKGROUND OF THE INVENTION

1. Field of the Invention

This invention concerns a radiating high-frequency coaxial cable and, more particularly, a radiating high-frequency coaxial cable with openings in the outside conductor, which essentially are slots placed perpendicular to the cable axis.

2. Description of the Prior Art

Radiating high-frequency coaxial cables have been known for a long time because they may be used as antennas, due to the electromagnetic energy escaping through slots formed in the cable's outside conductor. Such cables make communication between mobile receivers, carried for example on vehicles, and a fixed transmitter possible. Looking at the slot configuration over the entire cable length, the cable is essentially a string of series-connected antennas, which create a radiation field in the vicinity of the cable.

As is already known from commonly owned U.S. Pat. No. 5,276,413, a decrease in the intensity of the radiated output takes place along the cable length due to the natural cable attenuation and the radiation. In practice, this means that the system attenuation between a vehicle and the radiating cable increases along the cable length from the point where the high-frequency energy is fed into the cable. To ensure that the mobile receiver's received field strength is at least somewhat constant, the known radiating high-frequency cable disclosed in the above mentioned United States Patent provides compensation for the effect of the line attenuation by means of a special slot configuration. Accordingly the number of slots per period length increases along the cable in accordance with an appropriate rule. As is known from the article "Leaky coaxial cable with length-independent antenna receiving level" in International Wire & Cable Symposium Proceedings 1992, pages 748–756, this measure leads to an especially advantageous configuration for transmission frequencies to above 900 MHz. Since these types of cables are typically used in tunnels, to enable the transmission of messages to moving traffic or the transmission of messages from moving traffic to the outside, it is important for the slot configuration in the outside conductor of the high-frequency coaxial cable to compensate for the effect of the line attenuation over the longest possible length.

In using new techniques of tunnel construction, the length to be spanned by a radiating high-frequency coaxial cable is not easily obtained with the known cable construction methods. In such long cable lengths, to compensate for the increased line attenuation due to the increasing radiation along the cable length, and thereby creating an essentially constant signal level along the cable, slot configurations would be needed in the outside conductor which cannot be accommodated because of space reasons. Thus, an increase in the numbers of slots per length is not possible at the heavily perforated end of the cable for reasons of space. At the lightly perforated end of the cable, one slot per period length is needed to generate the clock pulse in the cable, so that no further "thinning out" can be accomplished there.

SUMMARY OF THE INVENTION

An object of the invention is to maintain the sum of coupling and line attenuation at a low, mostly constant level, in a radiating, high-frequency coaxial cable at cable lengths of 800 m and more.

Another object of the present invention is to maximize the cable length of a radiating, high-frequency coaxial cable while maintaining coupling and line attenuation at a sufficiently low, mostly constant level along the entire length of the cable.

A further object of the present invention is to provide a radiating, high-frequency coaxial cable having improved electrical and mechanical properties including a low dielectric constant and improved bending characteristics and lengthwise water-tightness.

It has been found that the foregoing objects can be readily attained by providing cable sections with repeating slot configurations along the cable, the cable section differ in period length when the number of slots is constant per period length, and/or the cable sections differ in the number of slots per period length when the period length is constant. Such radiating high-frequency cables can be more than 1000 m long and operate at frequencies of e.g. 900 to 960 MHz.

In addition to increasing the data transmission range, the invention also lead to a decrease in signal variations and to a decrease in signal dynamics of a mobile subscriber or transmitter. Increasing the maximum length of the radiating high-frequency cable with compensated line attenuation leads to increased flexibility in the tuning of the respective transmission system characteristics. Also, fewer feeding points and amplifiers are needed along the cable length, which, among other things, leads to lower costs, simplified maintenance and increased reliability. The present invention produces significant advantages in the transmission of information by radio in areas with unfavorable propagation conditions, for example along the above mentioned tunnel lengths, and also in parking garages, airport buildings, skyscrapers, etc.

If, as provided by the invention, the sections along the cable differ in period length while the number of slots remains the same, it is an advantage to reduce the period length along the cable starting from the feeding point. For example, an increase of about 10 dB was achieved with a transition from a section having a period length of 20 cm and one slot to an adjacent section having a period length of 17 cm and one slot. This example shows the variation possibilities given by the invention with regard to range, balance and radiation intensity of the radiating high-frequency coaxial cables. Further advantageous possibilities take place if the period length along the cable is decreased in several stages. The flexibility of the adaptation to the required range and the transmission characteristics can also be achieved by increasing the number of slots while decreasing the period length along the cable.

Further variations in the configuration of the solution according to the invention, in view of a required cable length and minimum system attenuations along this cable length, can be achieved by alternating sections with the same number of slots and a different period length, with sections of the same period length and a different number of slots. In this way, it is advantageous to join periodically occurring sections of decreasing period lengths with the same number of slots, to sections having the same period length with increasing numbers of slots, followed in turn by sections of decreasing period lengths with the same number of slots, to the end of the cable.

Known cable constructions provided with a generic configuration typically have an inside conductor, a plastic insulation surrounding the conductor, and an outside conductor over the plastic insulation, with a predetermined distribution of openings for the radiation energy to exit. This assembly is covered by a plastic outer jacket as disclosed in United Kingdom Document No. GB 20 62 359 A. Another known but different configuration disclosed in United Kingdom Document No. GB 21 27 621 A provides two layers of tape winding over the extruded insulation of the inside conductor, where the windings of each layer have gaps, forming openings through which the electromagnetic energy can exit. These constructions may not satisfy present requirements regarding lower dielectric constants, bending characteristics, lengthwise water-tightness, etc.

Therefore, in a further development of the present invention, the radiating high-frequency cable comprises a plastic tube, which is concentric with the inside conductor and maintains its position with respect to the inside conductor by spacers. The plastic tube further supports a band-shaped, slotted outside conductor. Such a construction, in which e.g. discs sprayed on the inside conductor are used as spacers, over which a thin plastic tube is extruded, forms closed sequential air chambers along the cable length, which contribute to the good electrical and mechanical properties of a cable according to the invention. The outside conductor of the radiating cable comprises a copper band, placed over the insulation of the inside conductor, which is a plastic tube extruded over a ring-shaped spacer in accordance with the invention. The band already contains the slot configuration required for this particular type of cable when the outside conductor is applied, the band is then wound lengthwise around the plastic tube, advantageously enough so that the band edges overlap, and no damage results from separation of the band edges, even during heavy bending of the cable. For this reason, it is also possible to join the overlapping band edges, perhaps by cementing or soldering.

The foregoing, and other objects, features and advantages of the present invention will become more apparent in light of the following detailed description of exemplary embodiments thereof, as illustrated in the accompanying drawings.

BRIEF DESCRIPTION OF THE DRAWINGS

FIG. 5 is a diagram of a first example of the present invention of a cable having eight (8) segments of different period lengths and different number of slots per period length;

FIG. 6 is a diagram of a second example of the present invention of a cable having eight (8) segments of different period lengths and different number of slots per period length; and FIG. 7 is a diagram of a third example of the present invention of a cable having eight (8) segments of different period lengths and different number of slots per period length.

DETAILED DESCRIPTION OF THE INVENTION

Figure 1:
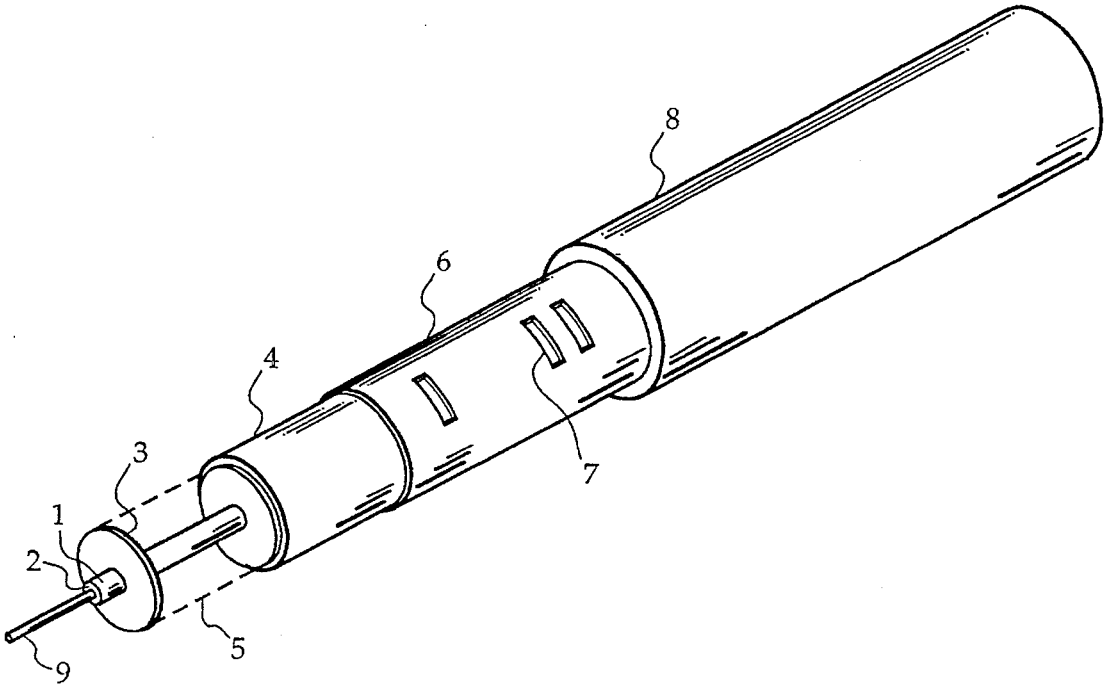
FIG. 1 is a perspective view, partially broken away, of a radiating high-frequency coaxial cable in accordance with the present invention.

FIG. 1 shows a radiating high-frequency coaxial cable, also called a leakage cable, for data transmission between stationary and mobile units and vice versa, for example for location in a railroad tunnel. Such a cable comprises an inside conductor 1, for example in the form of a metal band, preferably made of copper, laid around a polyethylene strand 2. A spacer disc 3 is placed on the inside conductor 1, over which a tube-shaped sheath 4 (insulation sheath) made of a thermoplastic material, for example polyethylene, is extruded. This construction forms self-contained air-filled chambers 5, which also provide lengthwise water-tightness to the cable. In addition, such a construction leads to a particularly low dielectric constant, low attenuation in the longitudinal direction, and good bending characteristics of the cable. An outside conductor 6, in this configuration example a copper band previously stamped with a respective configuration of slots 7, is laid lengthwise around the insulation sheath 4, so that the band edges (not shown) overlap each other. The band edges are kept in their overlapped position by cementing, soldering or welding, for example. External mechanical protection is provided by an outer jacket 8, made of an abrasion-resistant plastic, which can also be flame-resistant.

Recently, more and more optical elements have been integrated into energy or transmission systems. The cable according to the invention is suitable, as illustrated, to place an optical element, for example a hollow core 9 containing optical fibers, inside the plastic core 2.

Figure 2:
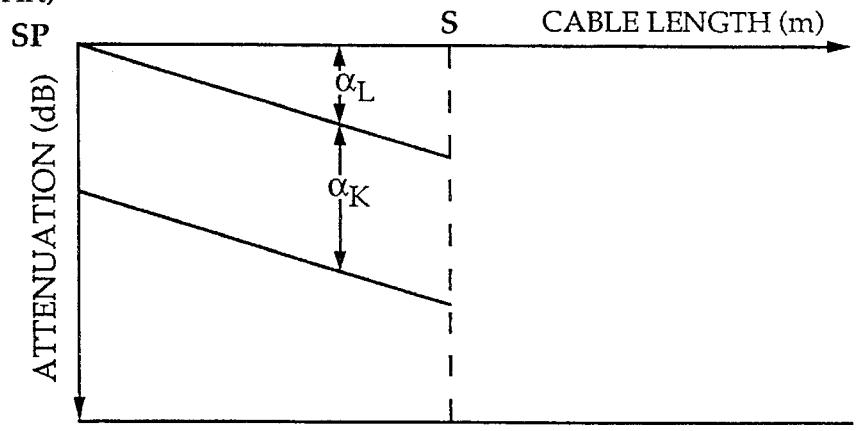
FIG. 2 (Prior Art)
FIG. 2 is a graph showing the line attenuation, $\alpha_L$, and coupling attenuation, $\alpha_K$, of a prior art cable with a constant number of slots within periods of the same length.
Figure 3:
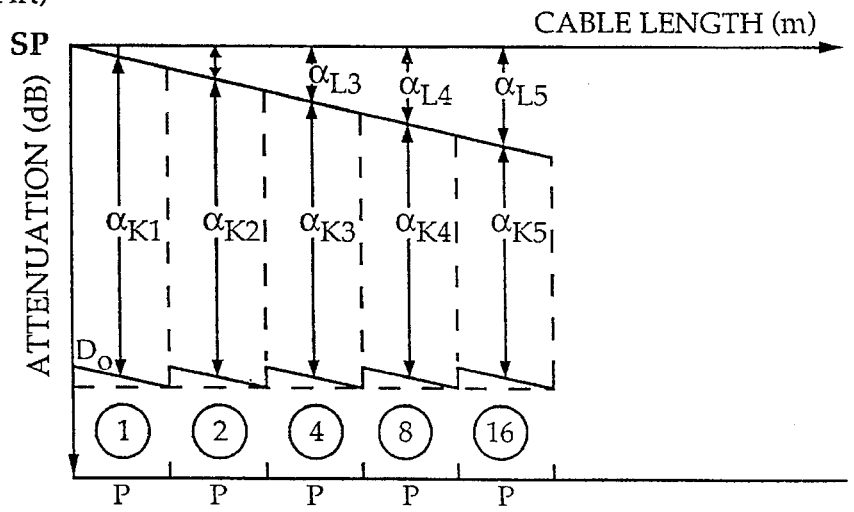
FIG. 3 (Prior Art)
FIG. 3 is a graph showing the line attenuation, $\alpha_L$, and the coupling attenuation, $\alpha_K$, of a cable having a constant period length and a varying number of slots per period length.

To clarify the invention, FIGS. 2 and 3 depict the attenuation properties of known cable configurations along each respective cable length. The period length in both cases is constant.

FIG. 2 shows the line attenuation $\alpha_L$ and the coupling attenuation $\alpha_K$ along the length of a so-called standard cable having segments with the same number of slots and the same period length. Because of the significant increase in system attenuation as seen from the feed point (SP) of the cable, only relatively short distances can be bridged by this cable.

By contrast, a significant improvement is exhibited by the so-called vario-cable characterized in FIG. 3. With a constant period length P, the outside conductor of this cable exhibits a different number of slots per period length. In the five illustrated periods, the outside conductor has one slot in the first section, then two, four, eight and sixteen slots in the subsequent sections. With this variation in the number of slots, the attenuation that increases according to the sawtooth curve along the cable is always raised again to the original value. With only a flat decreasing system attenuation, the field strength received along the cable can be held constant in a first approximation. The configuration of FIG. 3 is the subject of the above mentioned commonly owned, U.S. Pat. No. 5,276,413.

Figure 4:
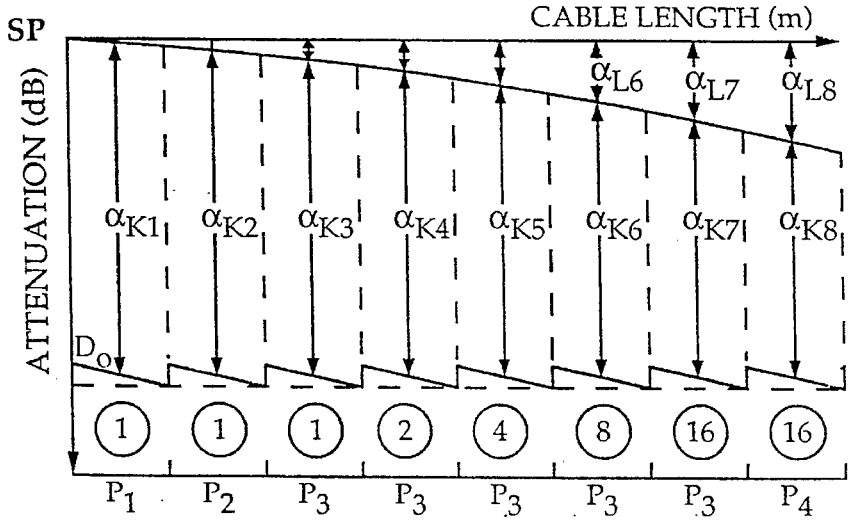
FIG. 4 is a graph showing the line attenuation, $\alpha_L$, and the coupling attenuation, $\alpha_K$, of a cable having varying period lengths and varying number of slots per period length in accordance with the present invention.

As previously mentioned, since the distance to be bridged with generic cables is always increasing, the measure in FIG. 3 may not always be enough. For that reason FIG. 4 illustrates a configuration of the present invention as a so-called double vario-cable with different numbers of slots and different period lengths. Starting from the feed-end of the cable (SP), the individual sections along the cable exhibit one slot in each of the first three sections, which is followed by two, four, eight and then sixteen slots in the last two sections. In this case the period length also varies with four different period lengths: $P_1$, $P_2$, $P_3$ and $P_4$. These two measures, namely the variation of the respective number of slots and/or the variation of the respective period length, because of the always recurring return of the system attenuation to the original value at the input end of the cable, lead to the particularly flat attenuation course depicted in FIG. 4, and thus exceed the cable lengths that were possible until now. At an operating frequency of 900 MHz, for example, and a total cable length of 1024 m, the cable of the invention exhibits an essentially constant signal level along the entire cable length.

The essentially constant signal level in FIG. 4 was measured in a radiating high-frequency coaxial cable according to the invention, constructed according to FIG. 1 with the slot configuration depicted schematically in FIG. 5. One slot is provided at the feed-end with a period length of 23 cm, followed by a section with a period length of 20 cm containing only one slot as well. The following five sections have a constant period length of 17 cm, and the number of slots per section being 1, 2, 4, 8 and 16 respectfully. In the final or eighth section of the configuration, there is a section with a period length of 16.5 cm having sixteen slots.

This configuration makes it clear that, in addition to the until now usual variation of the number of slots with a fixed period length, the variation of the period length with a fixed number of slots can also be used to produce different radiation intensities. In this way, it is possible to ensure compensation for the effect of line attenuation in longer cables, such as are used more and more in tunnels, so that a constant signal level can be achieved along the full path.

FIG. 6 depicts another configuration that deviates from the slot configuration in FIG. 5, to compensate for line losses, even over long distances, wherein the number of slots is constant with a period length that decreases at first, then the period length remains constant and the number of slots varies. Finally, the number of slots is constant in the final two sections of the cable, and the period length of the last section is decreased from the period length of the second to last section.

Finally, the example in FIG. 7 has a slot configuration wherein the number of slots is maintained and the period length is reduced in the first sections, then both the number of slots and the period length change, although in the opposite sense. This is another possibility of configuring the invention. In this case, it is essential that both the number of slots as well as the period length of the individual sections are changed along the path.

Although the invention has been described and illustrated with respect to exemplary embodiments thereof, the foregoing and various other changes, omissions and additions may be made therein and thereto without departing from the spirit and scope of the present invention.

What is claimed is:

1. A radiating high-frequency coaxial cable having an axis, comprising:

an outside conductor comprising a plurality of sections therealong, each of said sections having a period length, said outside conductor having a plurality of openings therein, said openings being slots having a major axis arranged perpendicular to the axis of the coaxial cable; and wherein a first type of adjacent sections have different period lengths and a constant number of slots per period length, and a second type of adjacent sections have a constant period length and a different number of slots per period length.

2. A radiating high-frequency coaxial cable according to claim 1, further comprising:

a feed-point on the coaxial cable for injecting high-frequency signals, and wherein for said adjacent sections having different period lengths and a constant number of slots per period length, the period length decreases along the cable length, as viewed from said feed-point.

3. A radiating high-frequency coaxial cable according to claim 2, wherein the period length decreases in uniform stages along the cable.

4. A radiating high-frequency coaxial cable according to claim 1, wherein the number of slots per period length increases with a decreasing period length.

5. A radiating high-frequency coaxial cable according to claim 1, wherein said adjacent sections having different period lengths and a constant number of slots per period length alternate with said adjacent sections having a constant period length and different number of slots per period length.

6. A radiating high-frequency coaxial cable according to claim 1, further comprising:

a feed-point on the coaxial cable for injecting high-frequency signals, and wherein beginning from said feed-point, said sections are grouped in two periodically recurring groups including a first group comprising adjacent sections with decreasing period lengths with constant numbers of slots per period length and a second group comprising adjacent sections with constant period lengths with increasing numbers of slots per period length.

7. A radiating high-frequency coaxial cable according to claim 1, further comprising:

an inside conductor;

a plurality of spacers positioned on said inside conductor;

a plastic tube positioned concentric to said inside conductor, said spacers maintaining a concentric relationship between said inside conductor and said plastic tube; and wherein said outside conductor is band-shaped and surrounds said plastic tube.

8. A radiating high-frequency coaxial cable according to claim 7, wherein said outside conductor has band edges which run in an axial direction along the coaxial cable, said band edges overlapping each other.

9. A radiating high-frequency coaxial cable, comprising:

an outside conductor comprising a plurality of sections therealong, each of said sections having a period length, said outside conductor having openings arranged therein; and wherein a first type of adjacent sections differ in period length and have a constant number of openings per period length, and a second type of adjacent sections have a constant period length and differ in the number of openings per period length.

10. A radiating high-frequency coaxial cable according to claim 9, further comprising:

a feed-point on the coaxial cable for injecting high-frequency signals, and wherein for sections of said first type, the period length decreases along the cable length, as viewed from said feed-point.

11. A radiating high-frequency coaxial cable according to claim 10, wherein the period length decreases in uniform stages along the cable.

12. A radiating high-frequency coaxial cable according to claim 9, wherein the number of openings per period length increases with a decreasing period length.

13. A radiating high-frequency coaxial cable according to claim 9, wherein sections of said first type alternate with sections of said second type.

14. A radiating high-frequency coaxial cable according to claim 9, further comprising:

a feed-point on the coaxial cable for injecting high-frequency signals, and wherein beginning from said feed-point, said sections are grouped in two periodically recurring groups including a first group comprising sections of said first type and a second group comprising sections of said second type.

15. A radiating high-frequency coaxial cable according to claim 9, further comprising:

an inside conductor;

a plurality of spacers positioned on said inside conductor;

a plastic tube positioned concentric to said inside conductor, said spacers maintaining a concentric relationship between said inside conductor and said plastic tube; and wherein said outside conductor is band-shaped and surrounds said plastic tube.

16. A radiating high-frequency coaxial cable according to claim 15, wherein said outside conductor has band edges which run in an axial direction along the coaxial cable, said band edges overlapping each other.

17. A radiating high-frequency coaxial cable according to claim 9 wherein the coaxial cable has an axis and wherein said openings are slots having a major axis arranged perpendicular to the coaxial cable axis.

18. A radiating high-frequency coaxial cable having an axis, comprising:

an outside conductor comprising a plurality of sections therealong, each of said sections having a period length, said outside conductor having a plurality of openings therein, said openings being slots having a major axis arranged perpendicular to the axis of the coaxial cable; and wherein adjacent sections have different period lengths and a different number of slots per period length.

19. A radiating high-frequency coaxial cable according to claim 18, wherein the number of slots per period length increases with a decreasing period length.

20. A radiating high-frequency coaxial cable according to claim 18, wherein the number of slots per period length decreases with a increasing period length.

21. A radiating high-frequency coaxial cable according to claim 18, further comprising:

an inside conductor;

a plurality of spacers positioned on said inside conductor;

a plastic tube positioned concentric to said inside conductor, said spacers maintaining a concentric relationship between said inside conductor and said plastic tube; and wherein said outside conductor is band-shaped and surrounds said plastic tube.

22. A radiating high-frequency coaxial cable according to claim 21, wherein said outside conductor has band edges which run in an axial direction along the coaxial cable, said band edges overlapping each other.

* * * * *

UNITED STATES PATENT AND TRADEMARK OFFICE

CERTIFICATE OF CORRECTION

PATENT NO. : 5,467,066

DATED : November 14, 1995

INVENTOR(S) : Karl Schulze-Buxloh

It is certified that error appears in the above-indentified patent and that said Letters Patent is hereby corrected as shown below:

ON THE TITLE PAGE:

INID [73] Assignee: "Moenchengladback, Germany"

should read

--Monchengladbach, Germany--

Signed and Sealed this

Twentieth Day of February, 1996

*Attest:*

Bruce Lehman

BRUCE LEHMAN

*Attesting Officer*

*Commissioner of Patents and Trademarks*